US007712322B2

(12) United States Patent
Kopf

(10) Patent No.: US 7,712,322 B2
(45) Date of Patent: May 11, 2010

(54) ICE LEVEL SENSING DEVICE FOR AN AUTOMATIC ICE MAKER IN A REFRIGERATOR

(75) Inventor: Bruce A. Kopf, Cedar Rapids, IA (US)

(73) Assignee: Maytag Corporation, Benton Harbor, MI (US)

( * ) Notice: Subject to any disclaimer, the term of this patent is extended or adjusted under 35 U.S.C. 154(b) by 817 days.

(21) Appl. No.: 11/353,944

(22) Filed: Feb. 15, 2006

(65) Prior Publication Data

US 2007/0186571 A1 Aug. 16, 2007

(51) Int. Cl.
*F25C 1/00* (2006.01)
*F25C 5/18* (2006.01)
*B65B 1/04* (2006.01)

(52) U.S. Cl. ..... 62/137; 62/344; 141/360

(58) Field of Classification Search ..... 62/135, 62/137, 344; 141/351, 360, 362
See application file for complete search history.

(56) References Cited

U.S. PATENT DOCUMENTS

| | | | | |
|---|---|---|---|---|
| 3,034,312 | A | 5/1962 | Harle | |
| 3,163,017 | A | 12/1964 | Baker et al. | |
| 3,331,215 | A | 7/1967 | Shaw | |
| 3,390,718 | A | 7/1968 | Gelbard | |
| 3,436,928 | A | 4/1969 | Swerbinsky | |
| 3,545,217 | A | 12/1970 | Linstromberg | |
| 3,675,437 | A | 7/1972 | Linstromberg | |
| 3,791,166 | A | 2/1974 | Maleck | |
| 3,885,400 | A | 5/1975 | Webb | |
| 3,964,269 | A | 6/1976 | Linstromberg | |
| 4,835,978 | A * | 6/1989 | Cole | 62/137 |
| 4,872,318 | A | 10/1989 | Klemmensen | |
| 5,119,639 | A | 6/1992 | Bein et al. | |
| 5,970,725 | A | 10/1999 | Lee | |
| 6,050,097 | A | 4/2000 | Nelson et al. | |
| 6,082,130 | A | 7/2000 | Pastryk et al. | |
| 6,148,620 | A * | 11/2000 | Kumagai et al. | 62/72 |
| 6,334,319 | B1 | 1/2002 | Senner | |
| 6,418,736 | B1 | 7/2002 | Cover | |

(Continued)

FOREIGN PATENT DOCUMENTS

| | | |
|---|---|---|
| JP | 52051148 | 4/1977 |

(Continued)

OTHER PUBLICATIONS

Temperatures.com, Thermocouples (TCs) http://www.temperatures.com/tcs.html.*

*Primary Examiner*—Chen-Wen Jiang
(74) *Attorney, Agent, or Firm*—Kirk W. Goodwin; Diederiks & Whitelaw, PLC

(57) ABSTRACT

A device for sensing a level of ice stored in a bin of an automatic ice maker includes a bail arm and an actuator mechanism. The actuator mechanism is constituted by a shape memory alloy that, upon application of a voltage, contracts to move the bail arm to a raised position prior to initiation of an ice harvest cycle. After completion of the ice harvest cycle, the voltage is discontinued, allowing the shape memory alloy to relax, causing the bail arm to return to a lowered position. The bail arm includes a sensing member that extends into the bin and, depending upon the level of ice, prevents the bail arm from contacting a sensing switch, temporarily halting ice production.

21 Claims, 3 Drawing Sheets

U.S. PATENT DOCUMENTS

| | | | | |
|---|---|---|---|---|
| 6,745,578 | B2 * | 6/2004 | Collins et al. | 62/71 |
| 6,916,159 | B2 * | 7/2005 | Rush et al. | 417/321 |
| 7,237,393 | B2 * | 7/2007 | Chung et al. | 62/137 |
| 2002/0002831 | A1 | 1/2002 | Huffman et al. | |
| 2002/0083726 | A1 | 7/2002 | Kim et al. | |
| 2003/0172664 | A1 * | 9/2003 | Collins et al. | 62/137 |
| 2005/0160757 | A1 * | 7/2005 | Choi et al. | 62/344 |
| 2005/0241329 | A1 * | 11/2005 | Castrellon et al. | 62/340 |

FOREIGN PATENT DOCUMENTS

| | | |
|---|---|---|
| JP | 4273963 | 9/1992 |

* cited by examiner

ICE LEVEL SENSING DEVICE FOR AN AUTOMATIC ICE MAKER IN A REFRIGERATOR

BACKGROUND OF THE INVENTION

1. Field of the Invention

The present invention pertains to the art of refrigerators and, more particularly, to a sensing device for detecting a level of ice present within an ice storage bin of an automatic ice maker system arranged within the refrigerator.

2. Discussion of the Prior Art

In the art of refrigerators, it is widely known to incorporate an automatic ice maker system wherein ice cubes are formed and collected within an ice storage bin. The ice cubes can either be accessed directly at the ice storage bin or through a dispenser. With such a system, provisions are commonly made to sense a level of ice cubes in the ice storage bin. A control is employed to automatically terminate the production of additional ice cubes when the amount of ice cubes in the storage bin reaches a predetermined level. Typically, the automatic ice maker will have an associated bail arm which rises and falls with the level of ice in the storage bin. When the level of ice causes the bail arm to shift upward a predetermined distance, the formation of additional ice is temporarily terminated. However, with this arrangement, often times ice can pile onto the bail arm in such a manner as to prevent the bail arm from shifting upward and terminating ice production.

To address this problem, some automatic ice makers are provided with a separate motor and cam arrangement, or utilize existing drive components, to raise the bail arm prior to an ice harvesting cycle. That is, prior to harvesting or ejecting ice cubes into the storage bin, the bail arm is raised so that ice cubes that are ejected into the bin do not pile onto or accumulate on the bail arm. However, while effective at preventing the bail arm from signaling a false negative, and allow ice to exceed preset levels, motor and cam arrangements increase the overall cost, complexity and size of the automatic ice makers. Additionally, the burden placed on existing drive components could detrimentally impact the service life of the ice maker. In the highly competitive field of kitchen appliances, it is advantageous to minimize manufacturing steps, eliminate potential failure points or otherwise increase the efficiency of an appliance without detracting from an overall established level of quality.

Based on the above, despite the existence of the automatic ice makers in the prior art, there still exists a need for an automatic ice maker system that includes a bail arm which is moved to a raised position prior to an ice harvesting cycle. More specifically, there exists a need for a bail arm that employs a simplified actuation mechanism to move the bail arm between the raised and lowered positions.

SUMMARY OF THE INVENTION

The present invention is directed to a device for sensing a level of ice cubes in a storage bin of an automatic ice maker. Specifically, the invention is directed to the actuation of a bail arm of the automatic ice maker. More specifically, prior to an ice harvesting cycle, the bail arm is automatically raised so that ice cubes, dropping into the storage bin, do not impede the movement of the bail arm. Other times, the bail arm simply rises and falls between a raised position, signaling the ice maker to terminate ice production, and a lowered position, signaling the ice maker to initiate or continue ice production.

In accordance with a preferred embodiment of the invention, the actuation of the bail arm is carried out by a shape memory alloy device (SMA) operatively connected to the bail arm. Prior to the ice harvest cycle, voltage is applied to the SMA causing the SMA device to contract and move the bail arm to the raised position. Once the bail arm is raised, the ice maker initiates the ice harvest cycle, dispensing ice cubes into the storage bin. At the completion of the ice harvest cycle, voltage is removed from the SMA device and the SMA device returns to a preset shape which allows the bail arm to return to the lowered position. If the bail arm is prevented from reaching a predetermined point, a signal is sent to the ice maker to terminate the production of ice.

In accordance with the most preferred embodiment of the invention, a sensing switch is operatively connected between the bail arm and the automatic ice maker. The sensing switch is positioned such that, when a level of ice in the storage bin reaches a predetermined point as determined by the position of the bail arm, ice production is terminated. The sensing switch includes a switch arm that, upon contact with the bail arm, triggers the sensing switch to signal the ice maker to resume ice production. That is, the switch arm is positioned so, when a level of ice in the storage bin is below the predetermined level, the bail arm will move further towards the lowered position, thereby contacting the switch arm and signaling a need for additional ice production.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
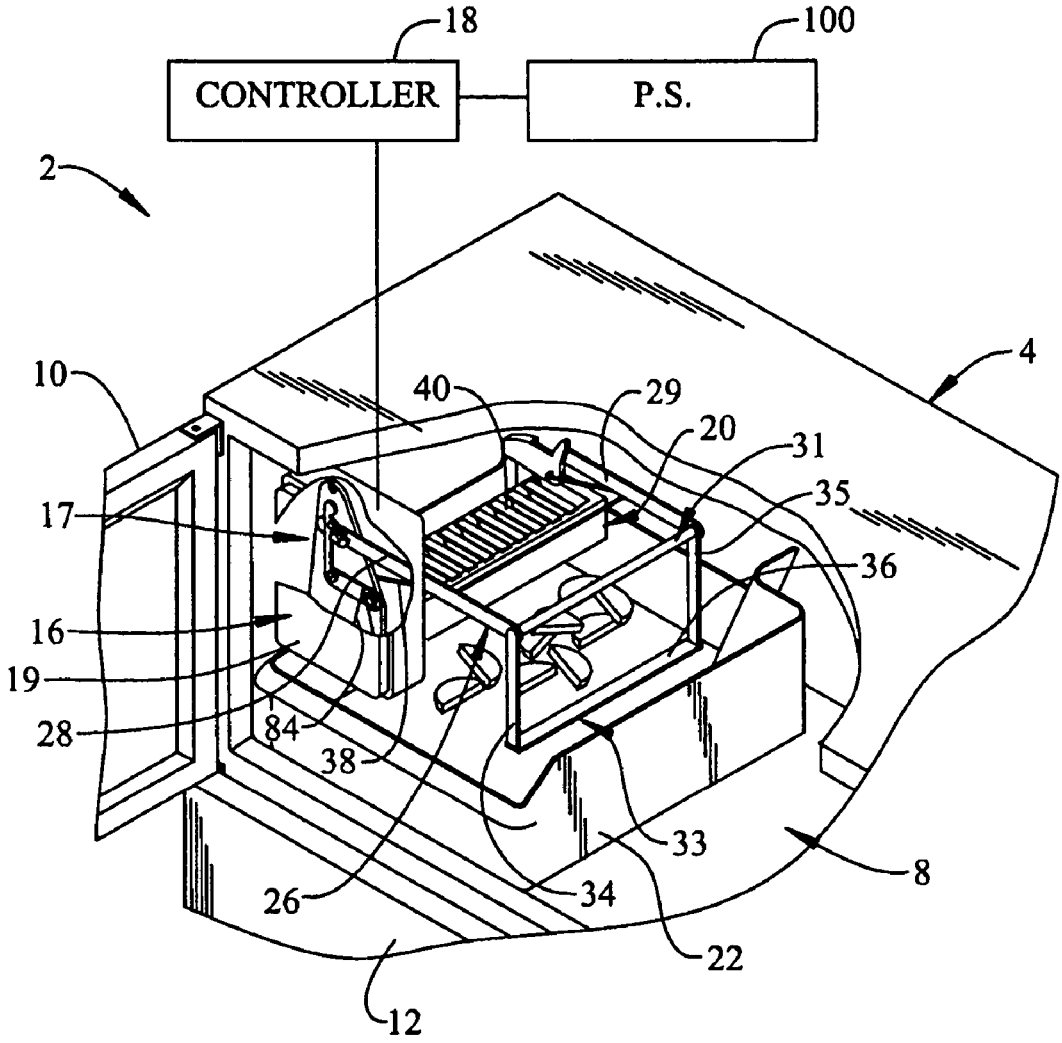
FIG. 1 is a partial, perspective view of a refrigerator depicting an ice level sensing device constructed in accordance with the present invention arranged within an upper freezer compartment.

With initial reference to FIG. 1, a refrigerator, generally indicated at 2, includes a cabinet 4 having arranged therein a freezer compartment 8 which can be selectively accessed through the pivoting of a freezer door 10. Also provided is a fresh food door 12 which enables access to a fresh food compartment (not separately labeled). As shown, refrigerator 2 constitutes a top mount style unit. However, as will become more fully evident below, the present invention is equally applicable to various other types of refrigerators, including side-by-side style units, bottom mount units and French door units.

Arranged within freezer compartment 8 is an ice maker assembly 16. In a manner known in the art, ice maker assembly 16 includes a body portion 17 supporting a controller 18 that is mounted behind a cover 19. Ice maker assembly 16 includes an ice maker unit 20 and an ice storage bin 22. Ice maker unit 20 is also shown to include a bail arm 26 having a pair of fore-to-aft spaced and generally parallel leg portions 28 and 29 which are interconnected by a cross leg portion 31. Additionally, ice maker assembly 16 includes a sensing member 33 pivotally connected to bail arm 26 so as to project into ice storage bin 22. In the embodiment shown, sensing member 33 includes a pair of fore-to-aft spaced and generally parallel leg sections 34 and 35 which are interconnected by a cross leg section 36. Leg portion 28 is shown to be operatively connected to a sensing switch 37 (FIG. 3) which, in the embodiment shown, is depicted as a micro switch. Actually, leg portion 28 abuts a sensing arm portion 38 of sensing switch 37 which, as will be described more fully below, controls an ice production cycle of ice maker assembly 16. Finally, ice maker unit 20 is shown to include an ice mold 40.

In general, this construction, as well as the operation, of ice maker unit 20 is known in the art. Basically, a flow of water is directed to ice mold 40 to fill up various cavities (not separately labeled) thereof in order to produce ice cubes which are deposited into storage bin 22. In a typical ice maker arrangement, once storage bin 22 has collected a sufficient amount of ice cubes, the ice cubes will act on bail arm 26 causing bail arm 26 to move from a lowered position to a raised position which, in turn, operates on sensing arm 38 to de-activate ice maker unit 20. Bail arm 26 and/or sensing arm 38 are preferably biased downward such that, when the level of ice cubes in storage bin 22 reaches a predetermined lower limit, ice maker unit 20 is automatically reactivated to restart the ice production cycle.

Figure 3:
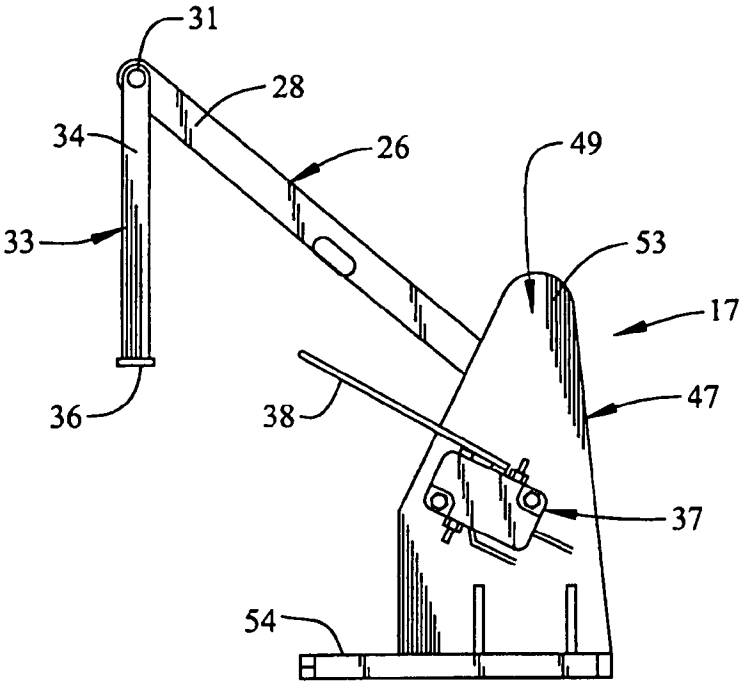
FIG. 3 is a side elevational view of the bail arm of FIG. 2, illustrating a sensing switch portion of the ice level sensing device.
Figure 2:
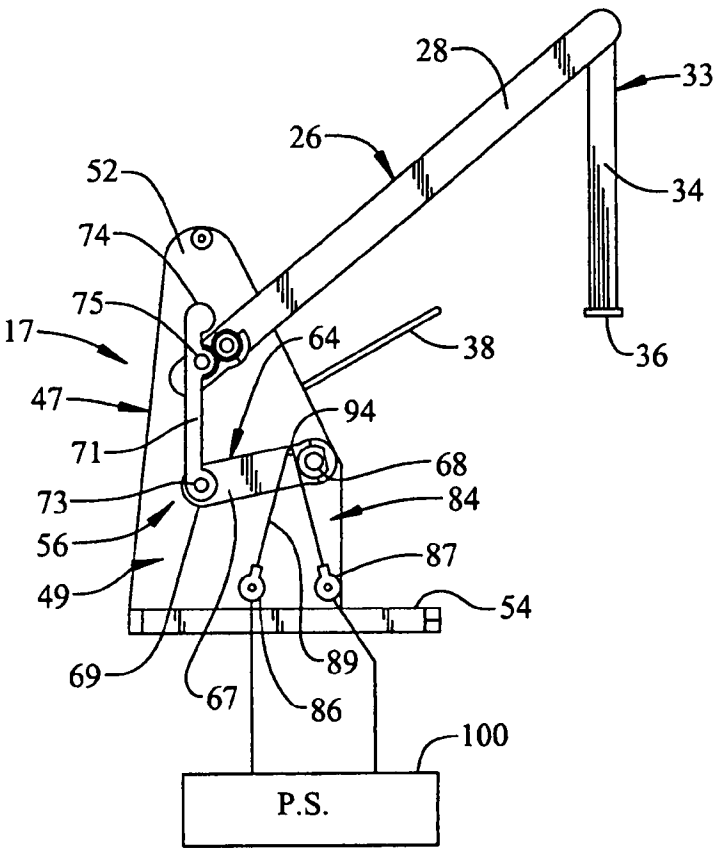
FIG. 2 is a side, elevational view of a bail arm of the automatic ice maker depicted in a raised position illustrating a shape memory alloy actuator portion of the ice level sensing device.
Figure 4:
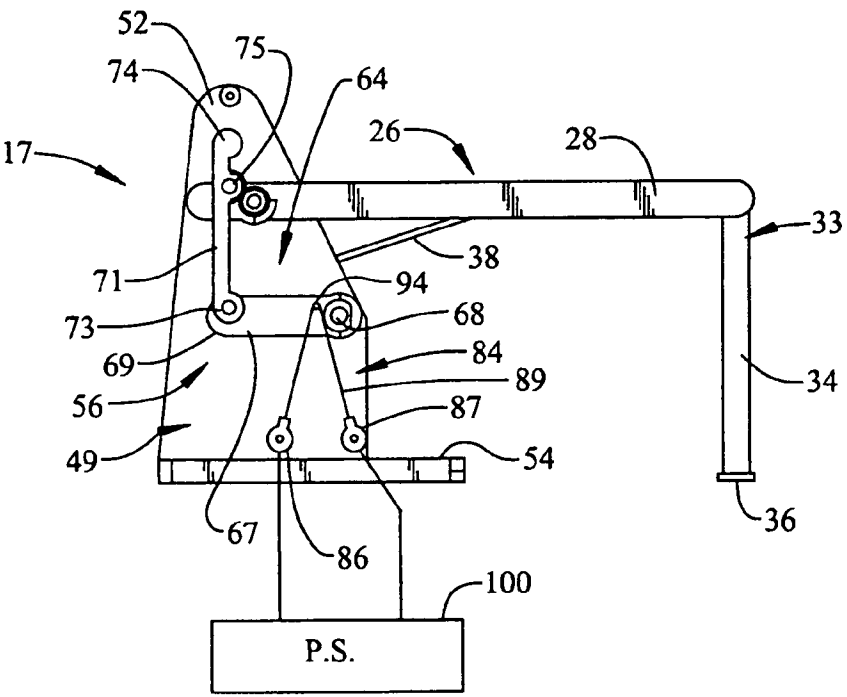
FIG. 4 is a side elevational view of the bail arm depicted in a lowered position illustrating the shape memory alloy actuator portion of the ice level sensing device.

As best shown in FIGS. 2-4, body portion 17 includes a support member 47 having a support wall 49. Support wall 49 includes a first support surface 52 and an opposing second, support surface 53. Support wall 49 extends generally perpendicularly from a base portion 54. In accordance with a preferred form of the invention, body portion 17 also includes an actuator mechanism 56 mounted on first support surface 52. Actuator mechanism 56 is operatively connected to bail arm 26 and, as will be discussed more fully below, controller 18. As best shown in FIG. 3, sensing switch 37 is mounted to second support surface 53 of support member 47, with sensing arm 38 projecting outward at an angle towards leg portion 28.

Figure 5:
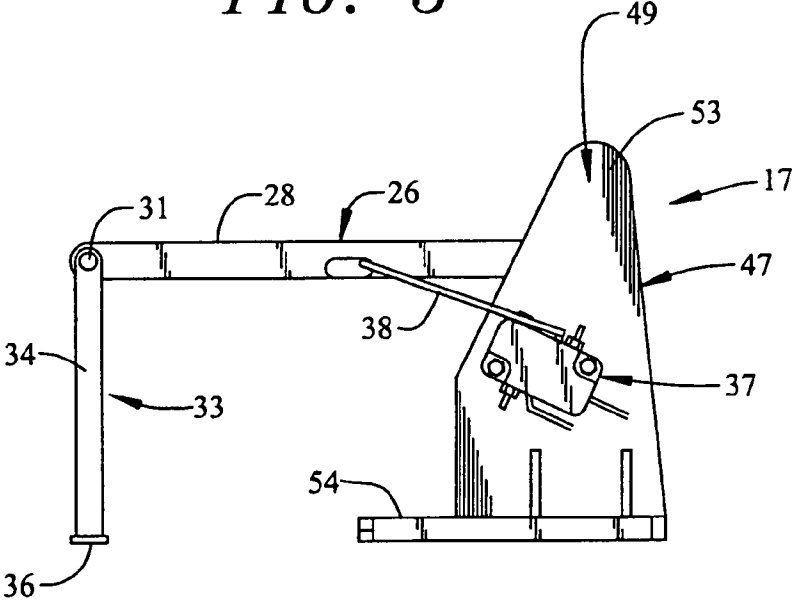
FIG. 5 is a side elevational view of the bail arm of FIG. 4, illustrating the sensing switch portion of the ice level sensing device.

In accordance with the most preferred form of the invention, actuator mechanism 56 includes a linkage assembly 64. As best shown in FIGS. 2 and 4, linkage assembly 64 includes a first member 67 having a fixed end portion 68 that extends to a pivoting end portion 69. Pivoting end portion 69 is linked to a second member 71 having a first end 73 that extends to a second end 74 through a connecting portion 75. Connecting portion 75 is pivotally secured to an end portion (not separately labeled) of leg portion 28. With this arrangement, a downward force acting on first member 67 will cause bail arm 26 to shift to a raised position as represented in FIGS. 2 and 3. After the force being applied to first member 67 is removed, bail arm 26 will return, under the force of gravity, to the lowered position as represented in FIGS. 4 and 5.

In further accordance with the most preferred form of the present invention, the force acting on first member 67 is provided by a shape memory alloy (SMA) device or actuator 84. As best shown in FIGS. 2 and 4, SMA device 84 is constituted by a Nitenol wire having a first end 86 extending to a second end 87 through an intermediate portion 89. At this point, it should be understood that, while Nitenol is employed as the preferred SMA device, other alloys, having substantially similar properties, are acceptable. In any event, intermediate portion 89 of SMA device 84 extends over a pin 94 provided on first member 67.

With this arrangement, prior to initiating an ice harvesting cycle, controller 18 activates a power source 100 coupled to first end 86 and second end 87 to supply a voltage to SMA device 84. The voltage causes SMA device 84 to contract, applying a downward force upon first member 67 through pin 94. The downward force applied to first member 67 causes bail arm 26 to move to the raised position as represented in FIG. 3. In the fully raised position, any ice that is released from ice mold 40 will not fall onto sensing member 33. That is, upon completion of an ice production cycle, controller 18 directs ice maker unit 20 to expel ice cubes into ice storage bin 22. If sensing member 33 remains within ice storage bin 22 during this cycle, ice cubes could, ultimately, accumulate on cross leg section 36 causing a failure in the overall operation of ice maker assembly 16. Thereby, prior to ejecting ice into storage bin 22, bail arm 26 is moved to the fully raised position. In any case, once the ice harvesting cycle has completed, controller 18 terminates the applied voltage across first and second ends 86 and 87, allowing the SMA device 84 to release and enabling bail arm 26 to return, under the force of gravity, to the lowered position.

In the event that the ice cubes have not reached a predetermined level in ice bin 22, cross leg section 36 of sensing member 33 will extend into ice storage bin 22 to a point where leg portion 28 contacts sensing arm 38 to signal a need for additional ice. Thus, ice maker assembly 16 will initiate another ice production cycle. In contrast, in the event that the ice cubes accumulated within ice storage bin 22 have reached the predetermined level, sensing member 33 will contact the ice cubes and prevent leg portion 28 from coming into contact with sensing arm 38, thereby signaling that no additional ice is needed. At this time, controller 18 terminates, at least temporarily, ice production. That is, ice production is terminated until leg portion 28 once again contacts sensing arm 38 to signal that more ice is needed. In any event, it should be understood that SMA device 84 provides a simple and cost effective means of actuating bail arm 26 prior to an ice harvesting cycle so as to increase an overall efficiency and ease of manufacture of ice maker assembly 16.

Although described with reference to a preferred embodiment of the present invention, it should be readily apparent to one of ordinary skill in the art that various changes and/or modifications can be made to the invention without departing from the spirit thereof. For instance, the bail arm could simply be formed as a single member provided with a pivoting sensing arm. Also the control portion assembly could be mounted in various fashions, such as on a shelf in the freezer compartment with the bail arm extending into a door mounted in the storage bin. In general, the invention is only intended to be limited to the scope of the following claims.

I claim:

1. A refrigerator comprising:

a cabinet including a refrigerated compartment;

an ice maker mounted in the refrigerated compartment, said ice maker including a body portion, an ice maker unit for receiving water and forming ice cubes during an ice production cycle, an ice storage bin for receiving ice cubes from the ice maker unit during a harvest cycle, and a device for detecting a level of ice cubes in the ice storage bin, said device including:

a bail arm pivotally mounted to the body portion for movement between a raised position and a lowered position for controlling the ice production cycle; and an actuator including a shape memory element operatively connected to the bail arm for moving the bail arm from the lowered position to the raised position for the ice harvest cycle and thereafter allowing the bail arm to return to the lowered position upon completion of the ice harvest cycle; and a controller for regulating operation of the shape memory element.

2. The refrigerator according to claim 1, further comprising: a sensing switch adapted to be operatively engaged by the bail arm, wherein the sensing switch prevents an ice production cycle when the bail arm is in the raised position.

3. The refrigerator according to claim 2, wherein the sensing switch interrupts power to the ice maker when the bail arm is unable to substantially return to the lowered position following the ice harvest cycle.

4. The refrigerator according to claim 2, wherein the body portion of the ice maker includes a support member having a base member and a support wall with first and second side portions, said support member supporting at least one of the actuator and the sensing switch.

5. The refrigerator according to claim 4, wherein the actuator is connected to the bail arm through a linkage, said linkage being provided on the first side portion of the support wall.

6. The refrigerator according to claim 5, wherein the linkage is constituted by a four-bar linkage.

7. The refrigerator according to claim 5, wherein the shape memory element is constituted by a wire having a first end, a second end and an intermediate portion, said first and second ends being affixed to the support member, with the intermediate portion being operatively connected to the linkage.

8. The refrigerator according to claim 7, further comprising: a power source, said power source being connected to the first and second ends of the wire.

9. The refrigerator according to claim 4, wherein the sensing switch is mounted to the second side portion of the support wall, said sensing switch including a switch arm adapted to be engaged by the bail arm.

10. The refrigerator according to claim 1, wherein the controller signals the ice maker to initiate an ice harvest cycle only after the actuator has shifted the bail arm to the raised position.

11. The refrigerator according to claim 1, further comprising: a sensing arm pivotally mounted to the bail arm, said sensing arm being adapted to extend into the ice storage bin.

12. An ice maker for a refrigerator comprising:

a body portion;

an ice maker unit for receiving water and forming ice cubes during an ice production cycle;

an ice storage bin for receiving ice cubes from the ice maker unit during a harvest cycle; and a device for detecting a level of ice cubes in the ice storage bin, said device including:

a bail arm pivotally mounted to the body portion for movement between a raised position and a lowered position for controlling the ice production cycle; and an actuator including a shape memory element operatively connected to the bail arm for moving the bail arm from the lowered position to the raised position for the ice harvest cycle and thereafter allowing the bail arm to return to the lowered position upon completion of the ice harvest cycle.

13. The ice maker according to claim 12, further comprising: a sensing switch adapted to be operatively engaged by the bail arm, wherein the sensing switch prevents an ice production cycle when the bail arm is in the raised position.

14. The ice maker according to claim 13, wherein the sensing switch interrupts power to the ice maker when the bail arm is unable to substantially return to the lowered position following the ice harvest cycle.

15. The ice maker according to claim 13, wherein the body portion of the ice maker includes a support member having a base member and a support wall with first and second side portions, said support member supporting at least one of the actuator and the sensing switch.

16. The ice maker according to claim 15, wherein the actuator is connected to the bail arm through a linkage, said linkage being provided on the first side portion of the support wall.

17. The ice maker according to claim 16, wherein the linkage is constituted by a four-bar linkage.

18. The ice maker according to claim 16, wherein the shape memory element is constituted by a wire having a first end, a second end and an intermediate portion, said first and second ends being affixed to the support member, with the intermediate portion being operatively connected to the linkage.

19. The ice maker according to claim 15, wherein the sensing switch is mounted to the second side portion of the support wall, said sensing switch including a switch arm adapted to be engaged by the bail arm.

20. The ice maker according to claim 12, further comprising: a sensing arm pivotally mounted to the bail arm, said sensing arm being adapted to extend into the ice storage bin.

21. A method of transferring ice from an automatic ice maker arranged in a refrigerated compartment of a refrigerator to an ice storage bin during an ice harvest cycle comprising:

moving a bail arm from a lowered position to a raised position through actuation of a shape memory element;

initiating the ice harvest cycle by expelling a plurality of ice cubes from the ice maker into the storage bin; and deactivating the shape memory element, allowing the bail arm to return to the lowered position.

* * * * *